US006746257B2

(12) United States Patent
Billman

(10) Patent No.: US 6,746,257 B2
(45) Date of Patent: Jun. 8, 2004

(54) ENHANCED MEMORY MODULE ASSEMBLY

(75) Inventor: Timothy B. Billman, Dover, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/269,140

(22) Filed: Oct. 10, 2002

(65) Prior Publication Data

US 2004/0072458 A1 Apr. 15, 2004

(51) Int. Cl.[7] ..... H01R 13/62
(52) U.S. Cl. ..... 439/160; 439/634; 439/637
(58) Field of Search ..... 439/160, 377, 439/634, 637, 65, 59

(56) References Cited

U.S. PATENT DOCUMENTS 4,392,700 A * 7/1983 Showman et al. ..... 439/260
4,392,705 A * 7/1983 Andrews et al. ..... 439/342
4,659,155 A * 4/1987 Walkup et al. ..... 439/108
4,932,888 A * 6/1990 Senor ..... 439/108
5,236,368 A * 8/1993 Adams et al. ..... 439/79
5,558,528 A * 9/1996 Cheng et al. ..... 439/160
5,634,803 A * 6/1997 Cheng et al. ..... 439/157
5,766,023 A * 6/1998 Noschese et al. ..... 439/74
6,123,558 A * 9/2000 Shibata ..... 439/157
6,244,879 B1 * 6/2001 Liu ..... 439/152

FOREIGN PATENT DOCUMENTS

JP 03105882 A * 5/1991 ..... H01R/23/68

* cited by examiner

*Primary Examiner*—Hae Moon Hyeon
(74) *Attorney, Agent, or Firm*—Wei Te Chung

(57) ABSTRACT

An enhanced memory module assembly comprises a memory module including a substrate with a plurality of conductive traces arranged in an edge thereof. A first connector is detachably and electrically assembled to the edge of the substrate and includes a first housing having an elongate slot extending along a longitudinal direction thereof. The housing further defines a plurality of terminal cell with a plurality of first terminals assembled therein. Each terminal includes a first end extending into the elongate slot for electrically contacting with the conductive traces, and second end. A second connector is electrically connected to the first connector and includes a second housing. The first and second terminals are electrically connected when the first and second connectors are mated.

19 Claims, 6 Drawing Sheets

ENHANCED MEMORY MODULE ASSEMBLY

FIELD OF THE INVENTION

The present invention relates to a memory module assembly, and more particularly to an enhanced memory module assembly in which the memory module is securely and firmly retained by a first connector and then connected to a second connector thereby providing reliable interconnection between the memory module and the connectors.

DESCRIPTION OF THE PRIOR ART

Workstations and servers have been widely used in working area. In order to overcome a sever environment, electrical device and components installed in the workstations and servers have to undergo severe test, typically a vibration test.

A connector for use with a memory module is generally referred to a DIMM (dual-in-line-memory-module) connector. A DIMM connector, as shown in U.S. Pat. No. 5,634,803 having the same assignee with the invention, generally includes an elongate housing defining an elongate slot along the longitudinal direction. A plurality of terminals arranged in the elongate slot for electrically connecting with the memory module. The housing further includes a pair of tower each with an ejector pivotally assembled thereto. The tower further defines a guiding slot for easy insertion of the memory module into the slot. However, in order to easily insert the memory module into the slot, the guiding slot is dimensioned to smooth the insertion. As a result, the memory module is simply retained by the contacting ends of the terminals, connections between contacting ends and conductive traces of the memory module can be negatively influenced under vibration. This situation becomes worse in high speed signal transmission.

U.S. Pat. Nos. 5,364,282; 5,429,523; 5,603,625; 5,775,925 and 5,928,015 issued to Tondreault address different solutions for the above-mentioned issue. The improvement is that ejectors which pivotally assembled to the towers are each provided with a pair of side panels thereby defining a slot therebetween. An edge of the memory module can be received in the slot thereby partially retaining an additional portion of the memory module to overcome the vibration. It seems to solve the problem at the present stage. However, since the signal transmission speed becomes higher and higher, this kind of arrangement is not longer meets the requirements of workstations and server.

In addition, the ejector is pivotally assembled to the tower through a pin and socket arrangement. Since both the ejector and tower are made from plastic material, wearing off is inevitably after a period of usage. Gradually, the retaining force exerted by the ejector is no longer good enough to securely retain the memory module.

Aside that the memory module shall be securely retained within the connector, another problem is the conductive traces arranged along the edge of the memory module. The conductive trace is a copper foil which is plated on a resin sheet. During insertion of the memory module into the connector, contacting ends of the connector will impose a wiping force to the copper foil. The copper foil can be easily peeled off if the insertion of the memory module is not carefully taken. As a result, this is another problem to be addressed.

SUMMARY OF THE INVENTION

It is an objective of this invention to provide an enhanced memory module assembly in which the memory module is securely and firmly retained by a first connector and then connected to a second connector thereby providing reliable interconnection between the memory module and the connectors.

It is another objective of this invention to provide an enhanced memory module in which conductive traces are electrically connected to the first connector, which is then stayed together with the memory module thereby preventing the conductive traces from being peeled off during repeatedly insertion and withdrawal to and from the connector.

In order to achieve the objective of this invention, an enhanced memory module assembly in accordance with the present invention comprises a memory module including a substrate with a plurality of conductive traces arranged in an edge of the substrate and includes a first housing having an elongate slot extending along a longitudinal direction thereof. The housing further defines a plurality of terminal cell with a plurality of first terminals assembled therein. Each terminal includes a first end extending into the elongate slot for electrically contacting with the conductive traces, and a second end. A second connector is electrically connected to the firs connector and includes a second housing defining a mounting face and a mating face. A plurality of second terminals corresponding to the first terminals is assembled in the second housing. The first and second terminals are electrically connected when the first and second connectors are mated.

These and additional objects, features, and advantages of the present invention will become apparent after reading the following detailed description of the preferred embodiment of the invention take in conjunction with the appended drawings.

DETAILED DESCRIPTION OF PREFERRED EMBODIMENT

Figure 1:
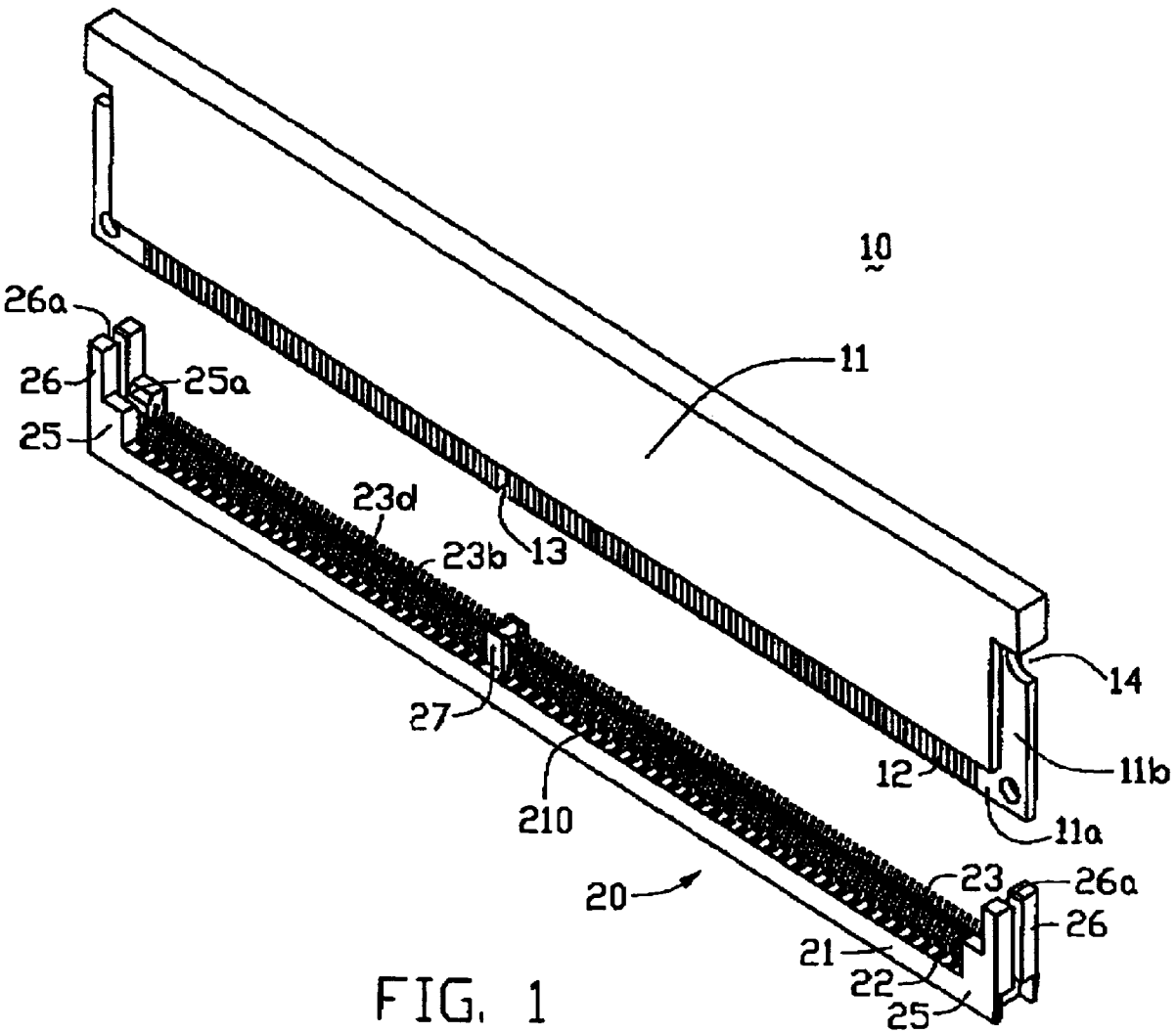
FIG. 1 is a perspective view of a memory module and a first connector.
Figure 2:
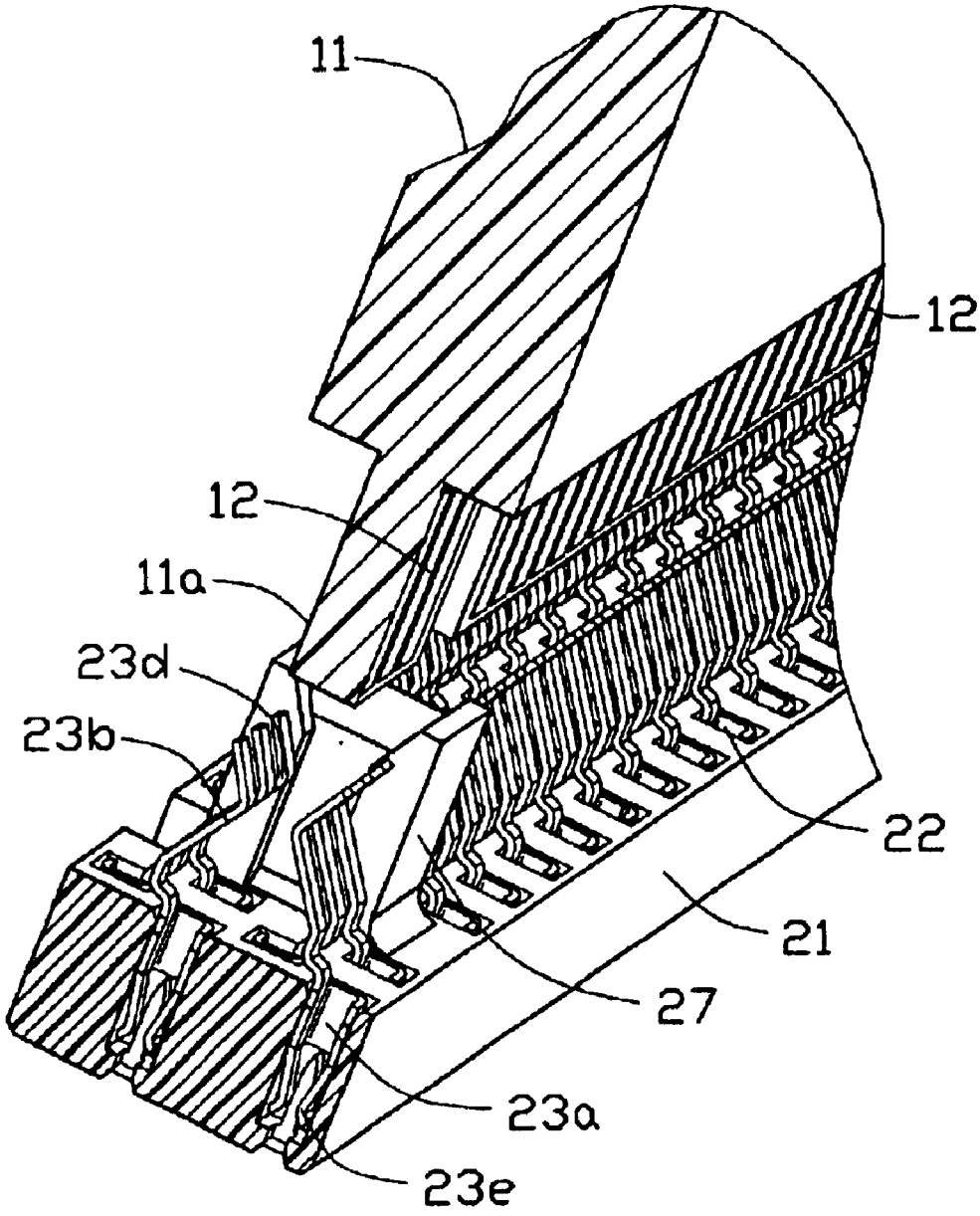
FIG. 2 is a perspective view of FIG. 1 viewed from another angle and with partially cross-sectioned.
Figure 3:
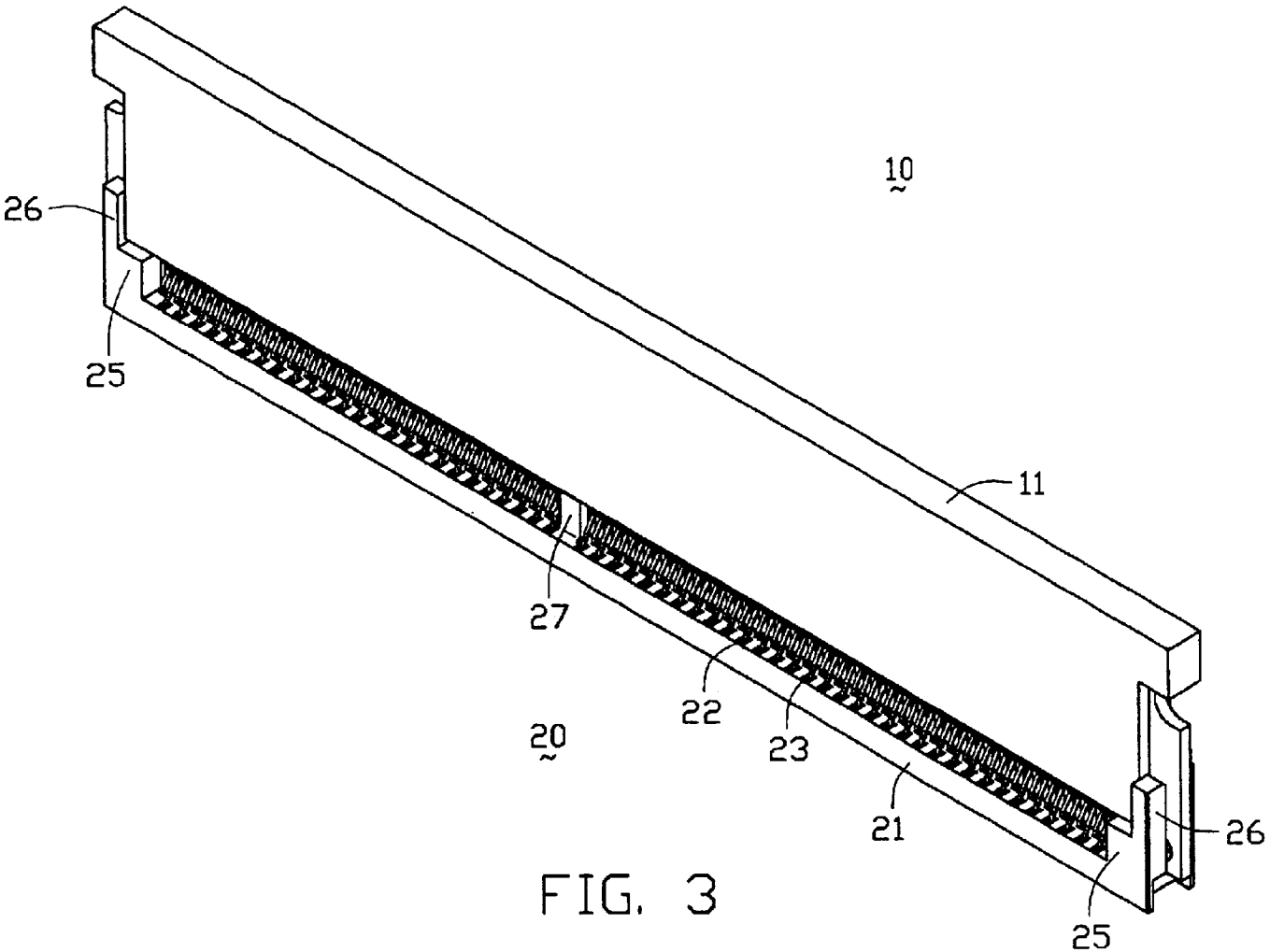
FIG. 3 is an assembled view of FIG. 1.
Figure 4:
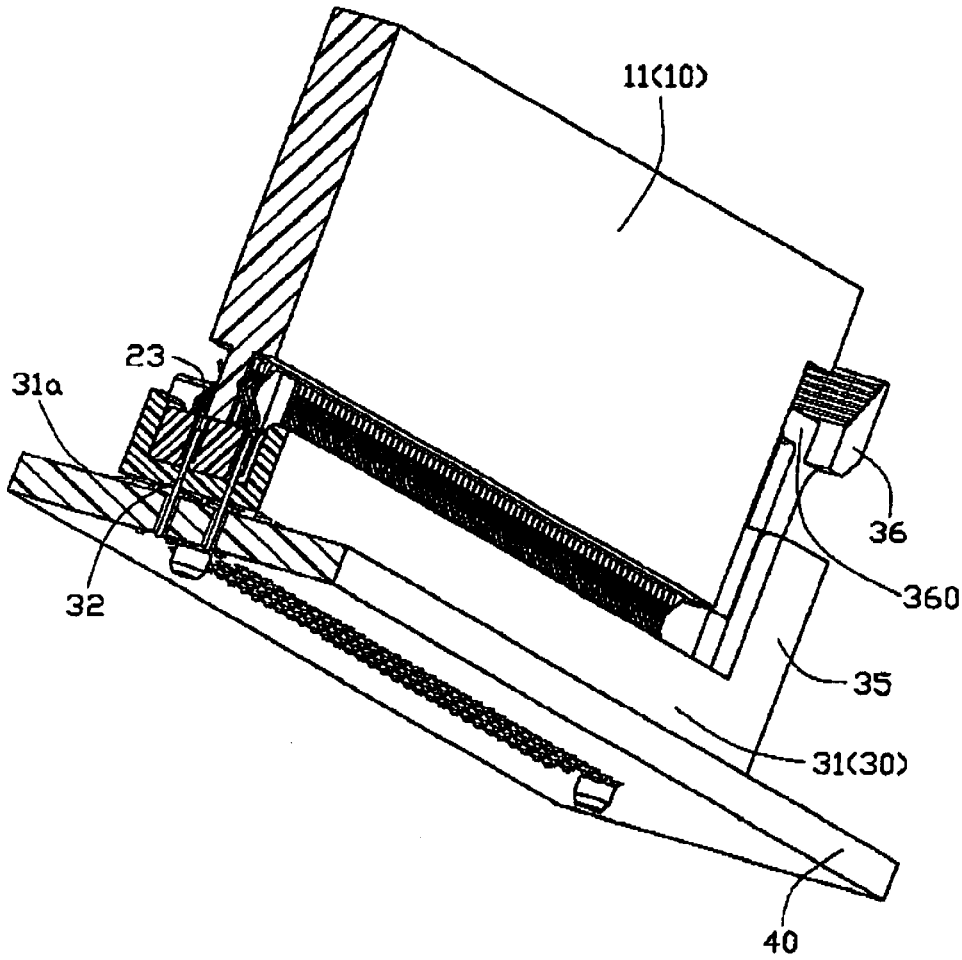
FIG. 4 is a partially cross-sectioned perspective view of the memory module, the first connector, a second connector, and a printed circuit board.
Figure 5:
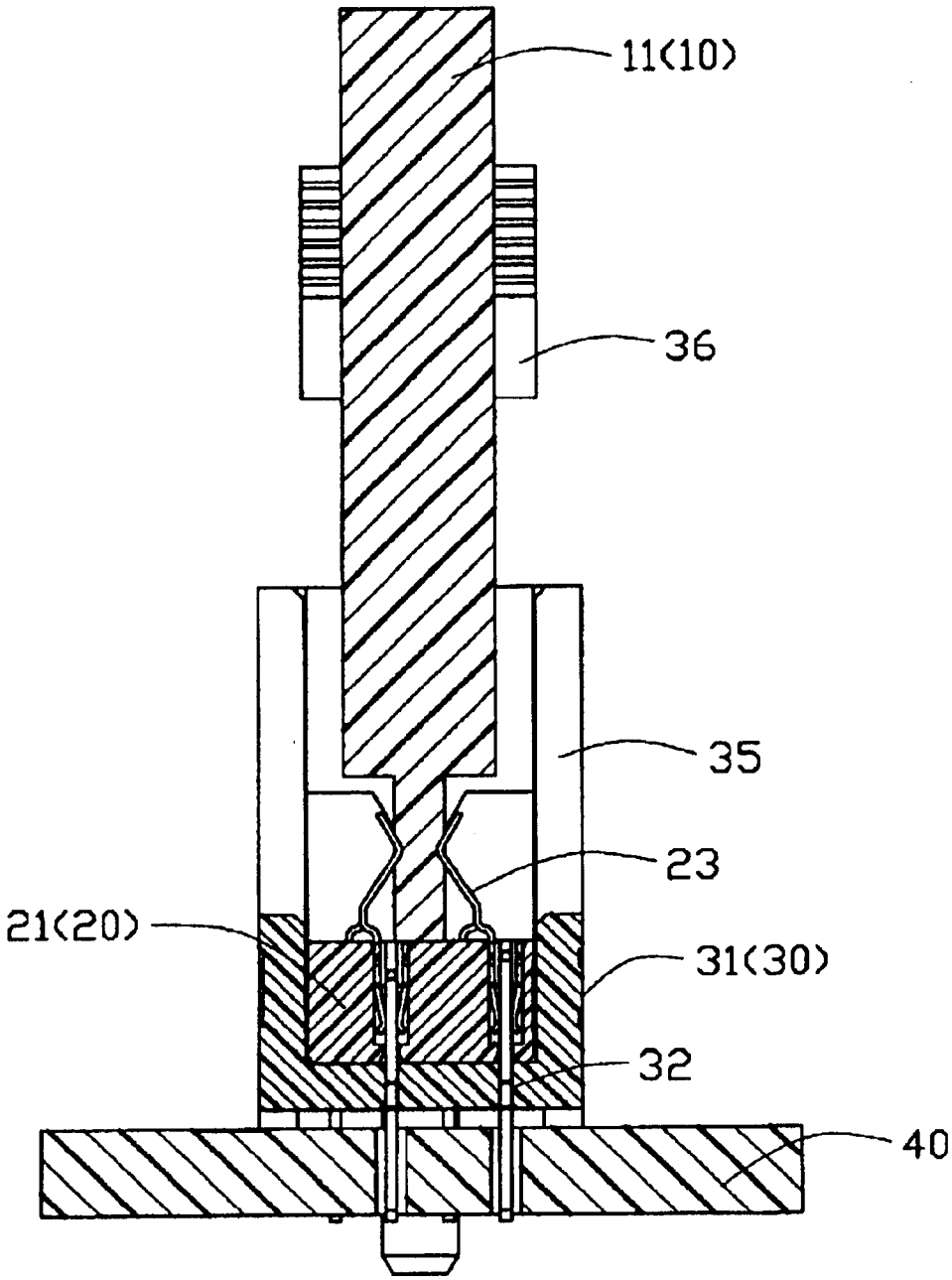
FIG. 5 is a cross sectional view of FIG. 4.
Figure 6:
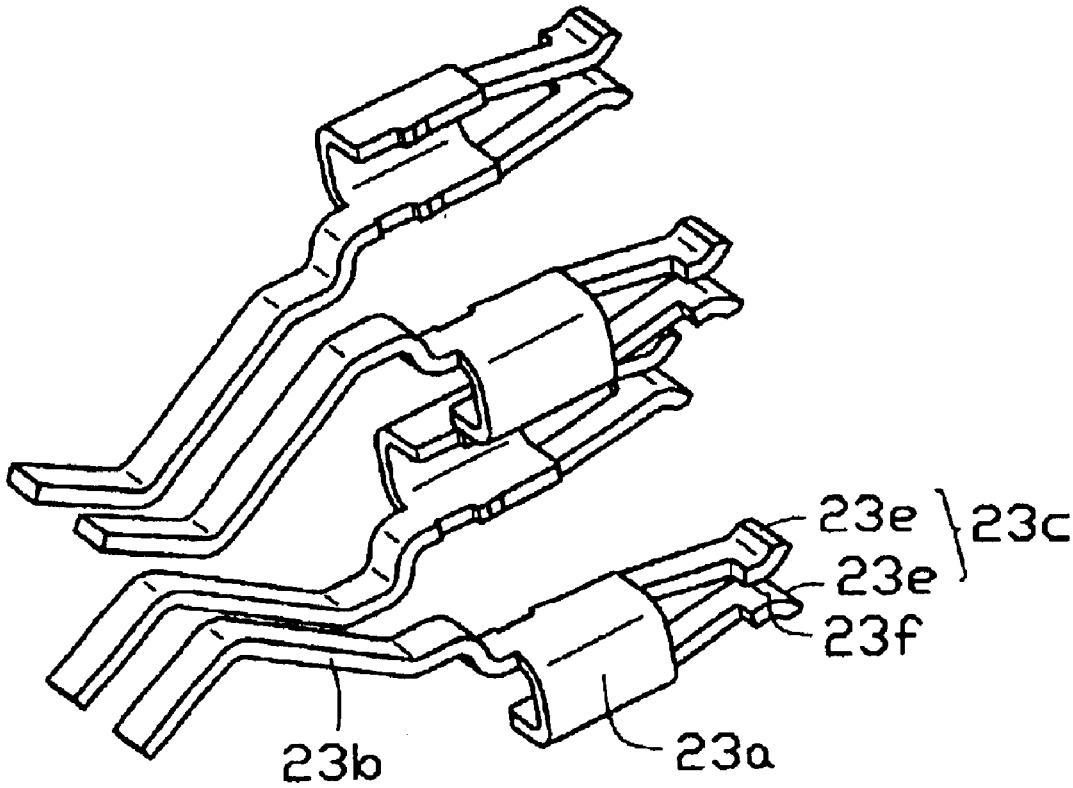
FIG. 6 is perspective view of a terminal used with the first connector.

Referring to FIGS. 1 to 6, an enhanced memory module assembly 1 in accordance with the present invention comprises a memory module 10 including a substrate 11 with a plurality of conductive traces 12 arranged in an edge 11*a* thereof. The memory module 10 also includes a plurality of other electronic devices which are not shown here.

A first connector 20 is detachably and electrically assembled to the edge 11*a* of the substrate 11 and includes a first housing 21 extending along a longitudinal direction thereof. The housing 21 further defines a plurality of terminal cell 22 with a plurality of first terminals 23 assembled therein. Each terminal 23 includes a base portion 23*a* securely retained in the cell 22, a first end or spring arm 23*b* extending toward each other thereby defining a mating slot 23*d* therebetween, and a tail portion 23*c* adapted to be electrically connected with a complimentary connector 30. The tail portion 23*c* includes a pair of contacting arms 23*e* jointly defining a socket 23*f* therebetween.

The first housing 21 of the first connector 20 includes a pair of towers 25 located at longitudinal ends thereof. Each tower 25 further defines a guiding slot 25*a* substantially retaining a portion of the substrate 11.

According to one aspect of the present invention, each tower 25 further includes a pair of reinforced pillars 26 which jointly define a retaining slot 26*a* for substantially retaining additional portion of the substrate 11.

According to another aspect of the present invention, the first housing 11 of the first connector 10 further includes a key 27 extending from said first housing 11 for serving as a polarizing device.

By the provision of the towers 25 and the reinforced pillars 26, the substrate 11 of the memory module 10 can be suitably and engaged with the first connector 10. In addition, the spring arms 23*b* are freely extending upward from the first housing 11, i.e. they provide excellent complimentary force toward the conductive traces 12 of the substrate 11. Accordingly, the conductive traces 12 are unlikely peeled off.

A second connector 30 seated upon a printed circuit board 40, is electrically connected to the first connector 20 and includes a second housing 31 defining a mounting face 31*a* and a mating face terminals 23 is integrally assembled in the second housing 31. The first and second terminals 23, 32 are electrically connected when the first and second connectors 20, 30 are mated, i.e. the second terminal 23 can be suitably inserted into the socket 23*f* defined between the contact arms 23*e*.

The second connector 30 is also provided with a pair of towers 35 and each is provided with an ejector 36 (for simplicity, only one tower 35 and one ejector 36 are shown). The ejector 36 can be used to disconnect the first connector 20 and the memory module 10 from the second connector 30 by a kicker (not shown) located around a bottom portion thereof and upwardly pushing the underside of the first connector to disengage the first terminals 23 from the corresponding second terminals 32. Thus, the memory module 10 is electrically disconnected from the printed circuit board 40. The operation/function of the ejector 36 is essentially similar to the conventional one as disclosed in the aforementioned U.S. Pat. No. 5,634,803. As a result, no further description is given.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

I claim:

1. An enhanced memory module assembly comprising:

a memory module including a substrate with a plurality of conductive traces arranged in an edge thereof;

a first connector detachably and electrically assembled to said edge of said substrate and including a first housing defining a plurality of terminal cells with a plurality of first terminals assembled therein, each first terminal including a first end resiliently abutting against a corresponding conductive trace and a second end, said first housing including a pair of towers and a pair of reinforced pillars having different heights located at opposite ends thereof, each of said towers and said reinforced pillars defining a slot for retaining said substrate; and a second connector electrically connected to said first connector and including a second housing,__a plurality of second terminals corresponding to said first terminals being assembled in said second housing, said first and second terminals being electrically connected when said first and second connectors are mated.

2. The enhanced memory module assembly as recited in claim 1, wherein said first connector further includes a key projecting upwardly beyond a top face of said first housing for serving as a polarizing device, and said memory module defines a cutout aligned with said key.

3. The enhanced memory module assembly as recited in claim 1, wherein said second end of said first terminal is a socket which electrically engages with said second terminal of said second connector.

4. An electrical connector assembly comprising:

a first connector defining a first housing with a plurality of first contacts therein:

a second connector defining a second housing with a plurality of second contacts therein;

a printed circuit board on which the second housing is seated;

said first housing and said second housing being detachably mated with each other with the corresponding first contacts and second contacts mechanically and electrically engaged with each other;

at least one ejector positioned around one end of the second housing; and a card-like memory module having an edge section releasably retainably engaged with the corresponding first contacts opposite to the second contacts; wherein said ejector includes a kicker around a bottom portion to eject the first housing away from the second housing, so as to disengage said first contacts from the corresponding second contacts.

5. The assembly as recited in claim 4, wherein said first housing is substantially received in the second housing.

6. The assembly as recited in claim 4, wherein said memory module is perpendicular to said printed circuit board.

7. The assembly as recited in claim 4, wherein said ejector includes a locker located around an upper portion thereof, said locker being releasably latched to a recess located in another edge section of the memory module when said memory module with the associated first connector are assembled to the second connector.

8. The assembly as recited in claim 7, wherein said another edge section is perpendicular to said edge section.

9. The assembly as recited in claim 4, wherein said ejector is located in a tower extending upwardly from one end of the second housing.

10. The assembly as recited in claim 4, wherein said edge section is retainably sandwiched between two rows of said first contacts.

11. The assembly as recited in claim 4, wherein said first connector further includes a key projecting upwardly beyond a top face of said first housing for serving as a polarizing device, and said memory module defines a cutout aligned with said key.

12. An electrical connector assembly comprising:

a first connector defining a first housing with a plurality of first contacts therein:

a second connector defining a second housing with a plurality of second contacts therein;

a printed circuit board on which the second housing is seated;

said first housing and said second housing being detachably mated with each other with the corresponding first contacts and second contacts mechanically and electrically engaged with each other;

a card-like memory module having an edge section releasably retainably engaged with the corresponding first contacts opposite to the second contacts, said memory module assembled to said first connector in a first direction; and at least one ejector positioned around one end of the second housing to eject the first housing away from the second housing, so as to disengage said first contacts from the corresponding second contacts.

13. The assembly as recited in claim 12, wherein said ejector is located in a tower extending upwardly from one end of the second housing.

14. The assembly as recited in claim 12, wherein said edge section is retainably sandwiched between two rows of said first contacts.

15. The assembly as recited in claim 12, wherein said first housing is substantially received in the second housing.

16. The assembly as recited in claim 12, wherein said memory module is perpendicular to said printed circuit board.

17. The assembly as recited in claim 12, wherein said first connector further includes a key projecting upwardly beyond a top face of said first housing for serving as a polarizing device, and said memory module defines a cutout aligned with said key.

18. The assembly as recited in claim 12, wherein said ejector includes a locker located around an upper portion thereof, said locker being releasably latched to a recess located in another edge section of the memory module when said memory module with the associated first connector are assembled to the second connector.

19. The assembly as recited in claim 18, wherein said another edge section is perpendicular to said edge section.

* * * * *